US006330911B1

(12) United States Patent
Allen et al.

(10) Patent No.: US 6,330,911 B1
(45) Date of Patent: Dec. 18, 2001

(54) TONG

(75) Inventors: John Timothy Allen; Steven Anthony Box, both of Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/267,546

(22) Filed: Mar. 12, 1999

(51) Int. Cl.[7] ..... E21B 19/16

(52) U.S. Cl. ..... 166/77.51; 166/85.1; 166/379; 81/57.18

(58) Field of Search ..... 166/379, 380, 166/77.51, 77.52, 77.53, 85.1; 254/30; 81/57.18, 57.2, 57.21

(56) References Cited

U.S. PATENT DOCUMENTS

| | | | |
|---|---|---|---|
| 1,512,675 | 10/1924 | Chryst . | |
| 1,955,727 | 4/1934 | Adams . | |
| 2,181,641 | 11/1939 | Hicks . | |
| 3,021,739 | 2/1962 | Grundmann . | |
| 3,023,651 | 3/1962 | Wallace | 81/57.18 |
| 3,086,413 | 4/1963 | Mason . | |
| 3,180,186 | 4/1965 | Catland | 81/57.18 |
| 3,380,323 | 4/1968 | Campbell . | |
| 3,507,174 | 4/1970 | Dickmann | 81/57.18 |
| 3,518,903 | 7/1970 | Ham et al. | 81/57.16 |
| 3,589,742 | 6/1971 | Flick . | |
| 3,635,105 | 1/1972 | Dickmann et al. | 81/57.18 |
| 3,875,826 | 4/1975 | Dreyfuss et al. | 81/57.18 |
| 3,892,140 | 7/1975 | Fox et al. | 74/224 |
| 3,957,113 * | 5/1976 | Jones et al. | 166/77.5 |

(List continued on next page.)

FOREIGN PATENT DOCUMENTS

| | | | |
|---|---|---|---|
| 1201279 B | 7/1992 | (DE) . | |
| 1226859 | 9/1968 | (GB) | B23B/21/00 |
| 2049517 A | 12/1980 | (GB) | B25B/17/00 |
| 2100639 A | 1/1983 | (GB) | B21B/19/16 |
| 3491280 * | 9/1982 | (SU) . | |
| PCT/EP92/00648 | 3/1992 | (WO) | B21B/19/16 |

OTHER PUBLICATIONS

Model 14–50 Hydraulic Power Ton, Installation, Operation and Maintenance; Weatherford Power Equipment; 1993.

Newl Weatherford Model 14.5—50 High Torque Ton, Weatherford, 1991.

Model 13375 H, 41½ —13, %—H–K Hydraulic Casing Ton, Joy Peetroleum Equipment, 1973.

Model 10750A, 4½ —103/4—H–K Air Powered Casing Tong, Joy Petroleum Equipment, 1973.

Model 3700H, 1.660H—4½ —H—K Hydraulic Powered Tubing Tong, Joy Petroleum Equipment, 1973.

(List continued on next page.)

*Primary Examiner*—Thomas B. Will
*Assistant Examiner*—Nathan Mammen
(74) *Attorney, Agent, or Firm*—Moser, Patterson & Sheridan, LLP.

(57) ABSTRACT

A tong for rotating tubulars, the tong having, in certain embodiments, a tong outer case, a rotary movably mounted in the case for rotating a tubular, apparatus for rotating the rotary to rotate the tubular, at least one gripper or jaw movably mounted in the case and movable by the rotary for gripping the tubular, the at least one gripper or jaw having at least one cam following member or roller, and at least one non-circular cam surface on the rotary, the at least one cam following member or roller contacting and movable on the at least one non-circular cam surface for maintaining a desired position of the at least one gripper or jaw with respect to the tubular. In certain embodiments a specific cam angle, within certain tolerances, is maintained substantially the entire length along a cam surface.

5 Claims, 11 Drawing Sheets

U.S. PATENT DOCUMENTS

| | | | | |
|---|---|---|---|---|
| 4,084,453 | | 4/1978 | Eckel | 81/57.18 |
| 4,192,206 | | 3/1980 | Schulze-Beckinghausen | 81/57.18 |
| 4,215,602 | | 8/1980 | Carstensen et al. | 81/57.18 |
| 4,246,809 | | 1/1981 | Keast et al. | 81/57.16 |
| 4,297,922 | | 11/1981 | Higdon | 81/57.18 |
| 4,401,000 | | 8/1983 | Kinzbach | 81/57.2 |
| 4,404,876 | | 9/1983 | Eckel | 81/57.18 |
| 4,437,363 | * | 3/1984 | Haynes | 81/57.18 |
| 4,442,736 | | 4/1984 | True et al. | 81/57.15 |
| 4,573,359 | | 3/1986 | Carstensen | 73/761 |
| 4,574,664 | | 3/1986 | Curry | 81/57.34 |
| 4,631,987 | | 12/1986 | Buck | 81/57.14 |
| 4,688,453 | | 8/1987 | Schulze-Beckinghausen | 81/57.18 |
| 4,739,681 | | 4/1988 | Pietras | 81/57.16 |
| 4,836,064 | | 6/1989 | Slator | 81/57.18 |
| 4,867,236 | | 9/1989 | Haney et al. | 166/77.5 |
| 4,869,137 | | 9/1989 | Slator | 81/57.18 |
| 4,972,741 | | 11/1990 | Sibille | 81/57.16 |
| 5,394,774 | | 3/1995 | Dlask | 81/57.18 |
| 5,435,213 | | 7/1995 | Buck | 81/57.18 |
| 5,451,084 | | 9/1995 | Jansch | 294/1.1 |
| 5,746,276 | | 5/1998 | Stuart | 173/1 |
| 5,845,549 | | 12/1998 | Bruligny | 81/57.33 |
| 5,904,075 | * | 5/1999 | Buck | 81/57.18 |

OTHER PUBLICATIONS

Clincher, Superior Manufacturing & Hydraulics, Inc., 1997.
Hydraulic Power Tons, Catalog 1980–1981, Eckel Mfg. Col.
Hydraulic Power Tongs, Operation and Service Instructions, Eckel Mfg. Co. 1979.
Product Catalog, Oilfield Service Solutions, Weatherford Petco, 1992 especially pp. i, 2, 4–7.
Hydraulic Power Tongs—"World Wide," Eckel Mfg. Co., 1993.
PCT/GB00/00824, Int'l Search Report.

* cited by examiner

TONG

BACKGROUND OF THE INVENTION

1. Field of the Invention

This invention is directed to operations involving the connection and disconnection of threaded tubular memebers, both at the surface in making and breaking connections with tongs and, in one particular aspect, in wellbore operations using wellbore tongs; to apparatus and methods for aligning wellbore tubulars; to power tongs used in making and breaking joints of tubular members such as pipe and wellbore casing and tubing; to parts thereof, including, but not limited to cam surface members elements; and methods of the use of these things.

2. Description of Related Art

Tongs are used to assist in the make-up and break-out of threaded tubular members. Certain operations during the drilling of oil and gas wells and the production of materials therefrom require the connection and disconnection of successive lengths of threaded tubulars such as pipe, casing, or tubing. Tools known as tongs are used to "make" and "break" such connections. Certain known power tongs have a body, a rotary rotatably mounted in said body and at least one active jaw with one, two or more cam rollers or followers, such a jaw (or jaws) on rotation of the rotary is cammed against a pipe in the rotary and grips it for rotation with the rotary. The camming action is typically generated by a cam member which is bolted to or machined as part of the rotary and is shaped so that the active jaw is cammed against the pipe on rotation of the rotary relative to the active jaw in one sense and will be released on rotation of the rotary relative to the active jaw in the opposite sense.

With known tongs, high torques are applied to tubulars due to combinations of factors such as thread sealing requirements, the presence of corrosion, the existence of distortion, and tolerances in pipe size and weight. Both in the "make" direction of rotation when a shoulder is suddenly encountered, and in the "break" direction at initial engagement of the tong and disengagement of the threads stresses may arise; e.g., with a power-driven tong, in excess of 50,000 foot-pounds of torque may be exerted, while die elements which may be relative small, or a jaw or jaws of the tong engage the pipe.

The grip mechanism of a tong translates a rotative input force into coplanar vector forces, acting chordally across the joint section. At the points of grip contact with the joint surface, these chordal forces are resolved into normal and tangential components relative to the joint contour and the rotative torque delivery capability of the tong system is a function of the normal component of the chordal vector multiplied by the coefficient of drag (friction) at the joint contact points of the grip elements. Grip elements are often provided with multiple serrations, or penetration features, to provide the interference contact needed at the joint surface for the development of a suitably high coefficient of drag (friction).

Torque delivery capability is a function of the normal force times the drag (friction) coefficient times the radius of the joint to be worked and the required magnitude of the normal force varies inversely with the coefficient of drag developed at the contact between the grip elements and the joint surface. Consequently, the distribution, balance and consistency of grip element energizing forces are critical factors in the design of a tong mechanism.

The prior art discloses a variety of mechanisms involving linkages, levers, wedges, and cams are in current use for the disposition and balance of the normal and tangential force components. Usually, grip elements, or dies, are disposed within carrier bodies, or jaws, which span a circumferential segment of the joint surface. These jaws are structured to accept the translated input chordal vector and deliver it to the joint surface in normal and tangential components.

FIG. 1H shows schematically a problem encountered with a prior art tong G having a jaw W with cam following rollers F. While one roller F may be maintained in contact with a corresponding cam surface of a rotary Y, the other roller F fails to contact a cam surface which can result in an unbalanced jaw/pipe contact. Another problem encountered with such systems occurs when both cam rollers are in contact with a cam surface, but jaw does not contact the pipe squarely. This is shown in FIG. 1H, and results in unbalanced contact of the jaw W with an outer surface of a pipe P, which can cause damage to the pipe P.

FIG. 2A shows a prior art tong N as disclosed in U.S. Pat. No. 4,404,876 which has cam surfaces $B_1$, $B_2$, $B_3$, $B_4$, $B_5$, and $B_6$ on a rotary D. Each of these cam surfaces is a part of a circle when viewed from above as in FIG. 2A. U.S. Pat. No. 4,404,876 discloses certain tong embodiments in which the cam angle does not exceed 5½ degrees; others in which the cam angle is substantially 2½ degrees; and others in which the cam angle is not substantially less than ½ degree. The cam angle for a tong, illustrated in FIG. 2B, is the angle between: (a) a line of action from the center of a rotary (which is also the center of the tubular being rotated) through a cam following member to a cam surface; and (b) a line through the cam following member normal to the cam surface at the point cam-following-member/cam-surface contact. The "cam angle" is defined in U.S. Pat. No. 4,404,876 as the angle formed by two lines originating at the point of contact between the cam and follower positioned when the dies are in contact with the pipe, by lines originating at the center of rotation of a rotary or partial ring of the tong and a point on a line perpendicular to the center line of a throat (for receiving a pipe section) and passing through the center of rotation and terminating at a point on the cam surface at which the cam follower or roller is positioned when dies or die carriers or jaws are in contact with a pipe section in the tong. Referring to a "cam angle" is a way of quantifying the ratio of tangential force and normal force applied through the cam from the rotary. The normal force at the jaw/pipe interface is equal to the above described normal force modified by the effect of any kinematic device between the jaw and the cam. Theoretically, it is preferred that an optimal cam angle be maintained for whatever position the cam follower or roller has on the entire length of the cam surface. In practice with various prior art circular-section cam surfaces, this is not achieved. FIGS. 1A–1G show a typical prior art power tong T that uses fixed or "centering" jaws J and a movable jaw M to grip pipe for tubular disconnecting and connecting operations. The jaws have gripping elements or dies D for engaging the pipe. An outer case C houses a powered rotary R to which fixed jaws J are mounted. A cam surface S of the rotary moves a movable (ACTIVE or MASTER) jaw M into (and away from) gripping contact with a tubular, e.g. pipe. The movable jaw M has one or two rollers L that move on the cam surface of the rotary. Each jaw has toothed gripping inserts to facilitate engagement with the surface of the tubular (see FIG. 1F). FIG. 1G shows the tong T in an "OPEN" position in which the tubular is not gripped. The cam surface S is defined by surfaces $S_1$, $S_2$, $S_3$, $S_4$, $S_5$, and $S_6$ on cam inserts I which are secured to the rotary R. Each of these surfaces is defined by part of a circle when viewed from above.

The prior art tong shown in FIG. 1A is a Weatherford Model 14.5–50 High Torque Tong. The brochure "New! Weatherford Model 14.5–50 High Torque Tong," (1991) and the manual entitled "Model 14.5–50 Hydraulic Power Tong Installation, Operation and Maintenance" (1993) are submitted herewith and incorporated herein fully by reference for all purposes. It is to be understood that the teachings of the present invention are applicable to any tong and any tong system that has one or more grippers or jaws and one or more cam surfaces and that the Model 14.5–50 tong is shown here for illustrative purposes and not by way of limitation of the scope of the present invention.

There has long been a need for a tong which applies a consistent force to a tubular to be rotated. There has long been a need for such a tong that efficiently rotates the pipe without damaging it and without slipping on it. There has long been a need for a tong with a jaw or jaws with two rollers in which the two rollers are maintained in contact with a tong cam surface.

SUMMARY OF THE PRESENT INVENTION

The present invention, in certain embodiments, discloses a power tong for use in operations for joining and disconnecting wellbore tubulars.

In certain aspects a tong is disclosed that has a tong outer case, a rotary movably mounted in the case for rotating a tubular, apparatus for rotating the rotary to rotate the tubular, at least one gripper (e.g., but not limited to a jaw and/or other known gripping elements) movably mounted in the case and movable by the rotary for gripping the tubular, the at least one gripper having at least one cam following member (e.g., but not limited to, a cam follower structure or roller), and at least one non-circular cam surface on the rotary, the at least one cam following member contacting and movable on and with respect to the at least one non-circular cam surface for maintaining a desired position of the at least one gripper with respect to the tubular. Preferably, in this desired position, the at least one jaw (and/or a die, dies, and/or gripping structure thereon) does not slip on the pipe and does not crush or damage the pipe.

In one aspect, "cam angle" as used herein is a way of quantifying the ratio of tangential force and radial force applied therough a cam from a rotary of a tong. The radial force at a jaw/pipe interface is equal to the radial force modidfied by the effect of any kinematic device between the jaw and the cam (see FIG. 2B). The tangential (torquing) force componenet at the jaw/pipe interface is the tangential force multiplied by the ratio of the raidal distance from a cam/roller interface to the pipe center and the radius of the pipe, modified by the effect of any kinematic device between the jaw and the cam.

It is, therefore, an object of at least certain preferred embodiments of the present invention to provide:

New, useful, unique, efficient, nonobvious wellbore tongs and parts thereof, and methods for rotating tubular members, and in one aspect for doing so in wellbore operations;

Such methods and devices including a power tong with at least one movable gripper with or without gripping elements and/or dies thereon;

Such a tong with one or more cam followers or cam following rollers on a gripper and one or more non-circular cam surfaces on a rotary of the tong;

Such tongs including structure and apparatus to apply a consistent force to a gripper so the gripper adequately grips a tubular without slipping on it, crushing it, or damaging it;

Such a tong with a gripper or gripper and/or with a jaw or jaws with two cam following members or rollers and non-circular cam surfaces so that consistent contact is enhanced and maintained between the cam following members or rollers, the cam surfaces, and the pipe, and therefore consistent desired forces; and Parts for and methods of using such a tong.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious devices and methods for aligning tubulars in wellbore operations.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
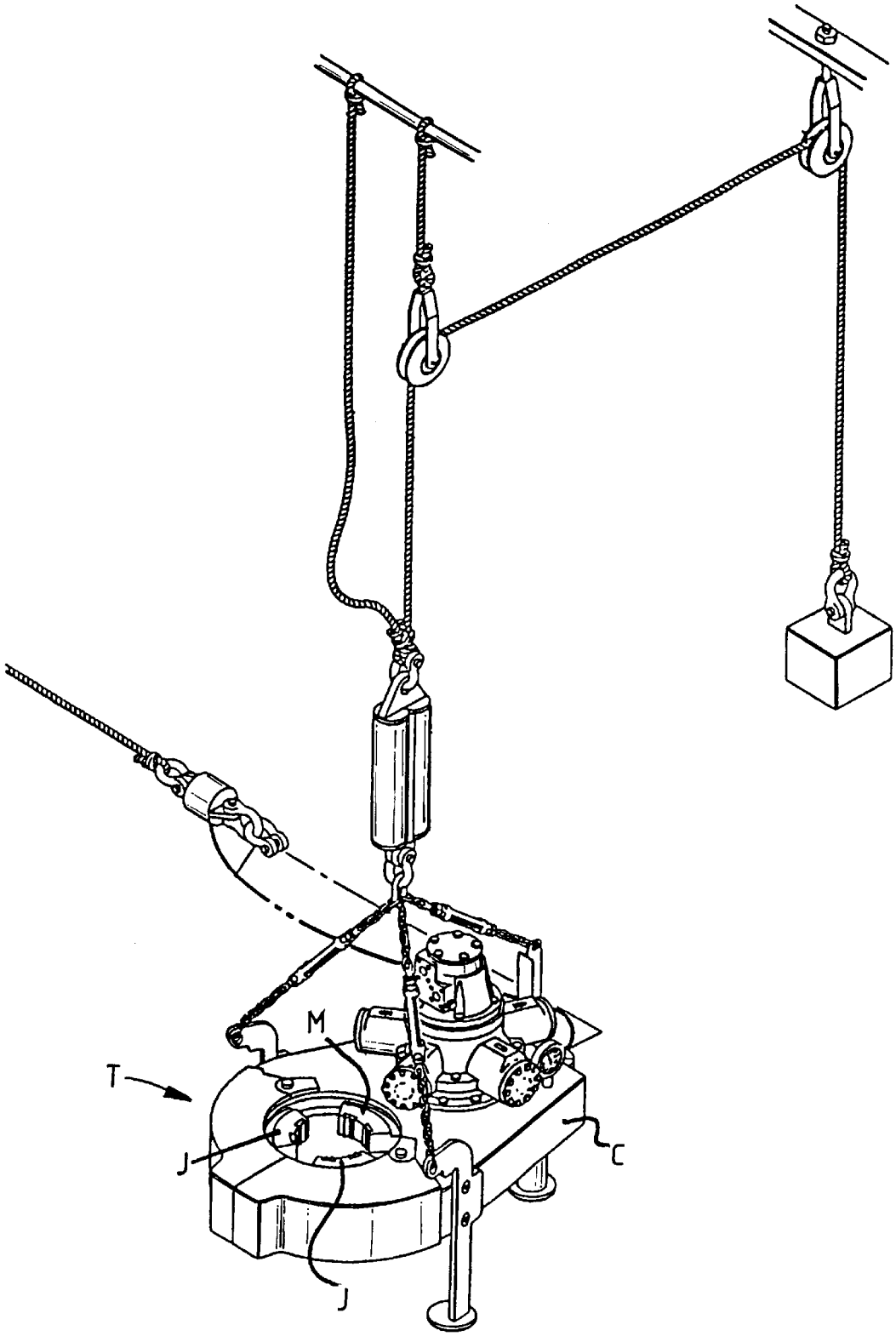
Fig. 1A Prior Art
FIG. 1A is a schematic perspective view of a prior art power tong system for wellbore operations.
Figure 1B:
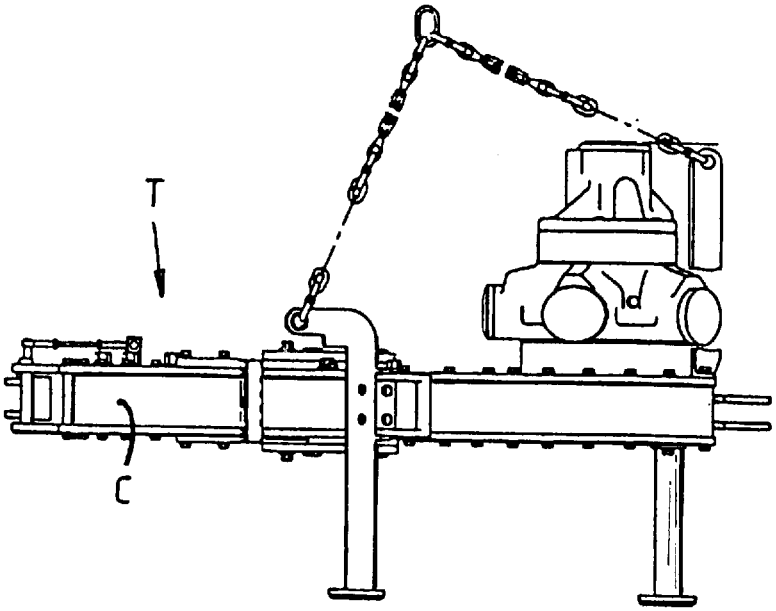
Fig. 1B Prior Art
FIG. 1B is a side view and FIG. 1C is a top view of part of the tong system of FIG. 1A.
Figure 1C:
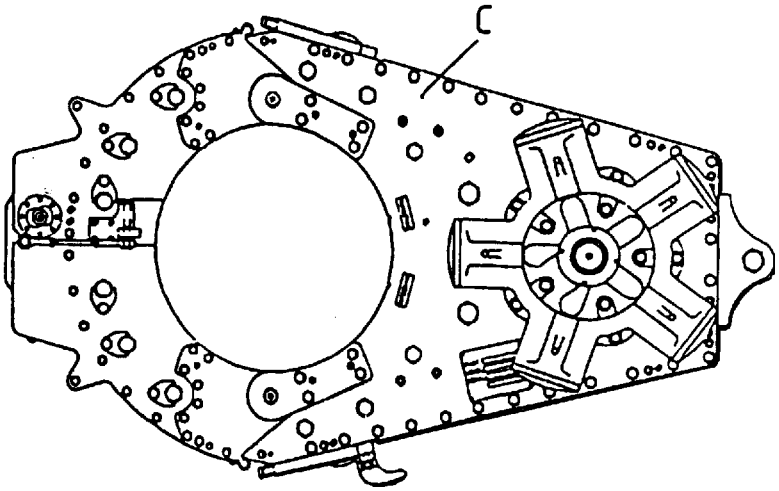
Fig. 1C Prior Art
Figure 1D:
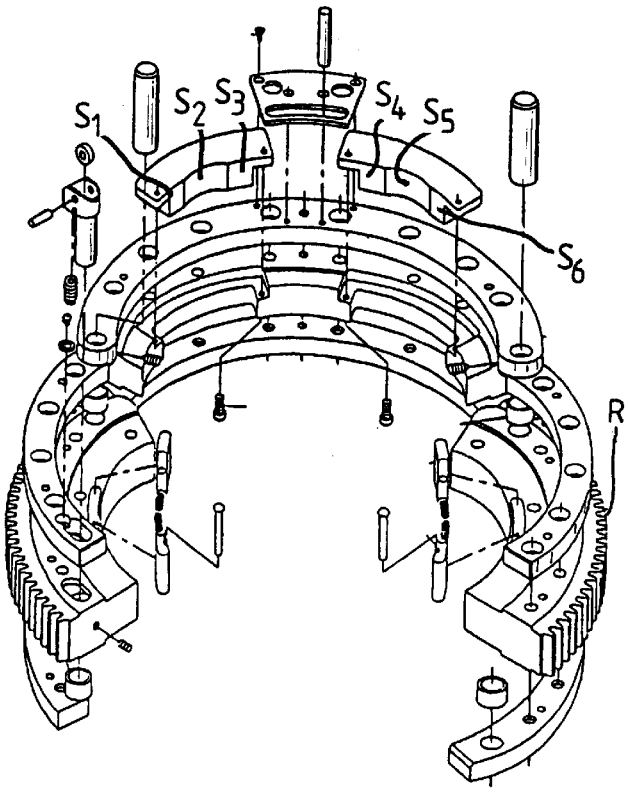
Fig. 1D Prior Art
FIG. 1D is an exploded view of a rotary assembly of the system of FIG. 1A.
Figure 1E:
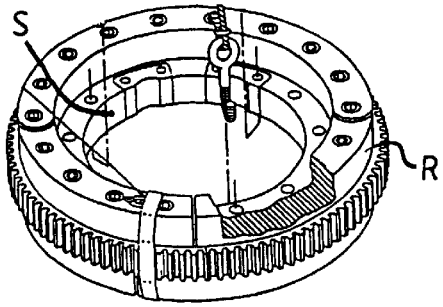
Fig. 1E Prior Art
FIG. 1E is a top perspective view of a rotary of the rotary assembly of FIG. 1D.
Figure 1F:
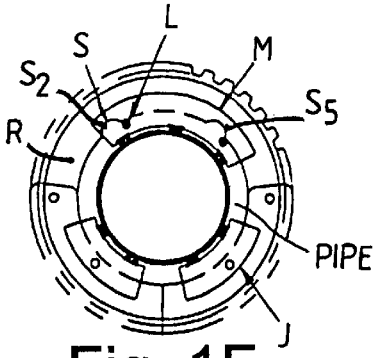
Fig. 1F Prior Art
FIGS. 1F and 1G are top schematic views of a rotary and jaws of the tong system of FIG. 1A.
Figure 1G:
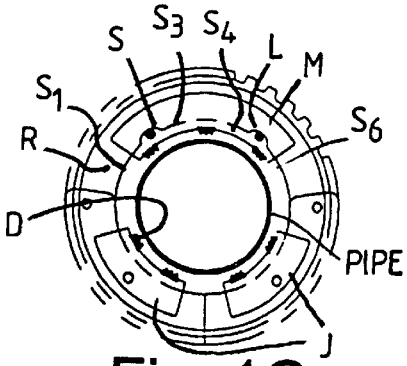
Fig. 1G Prior Art
Figure 3A:
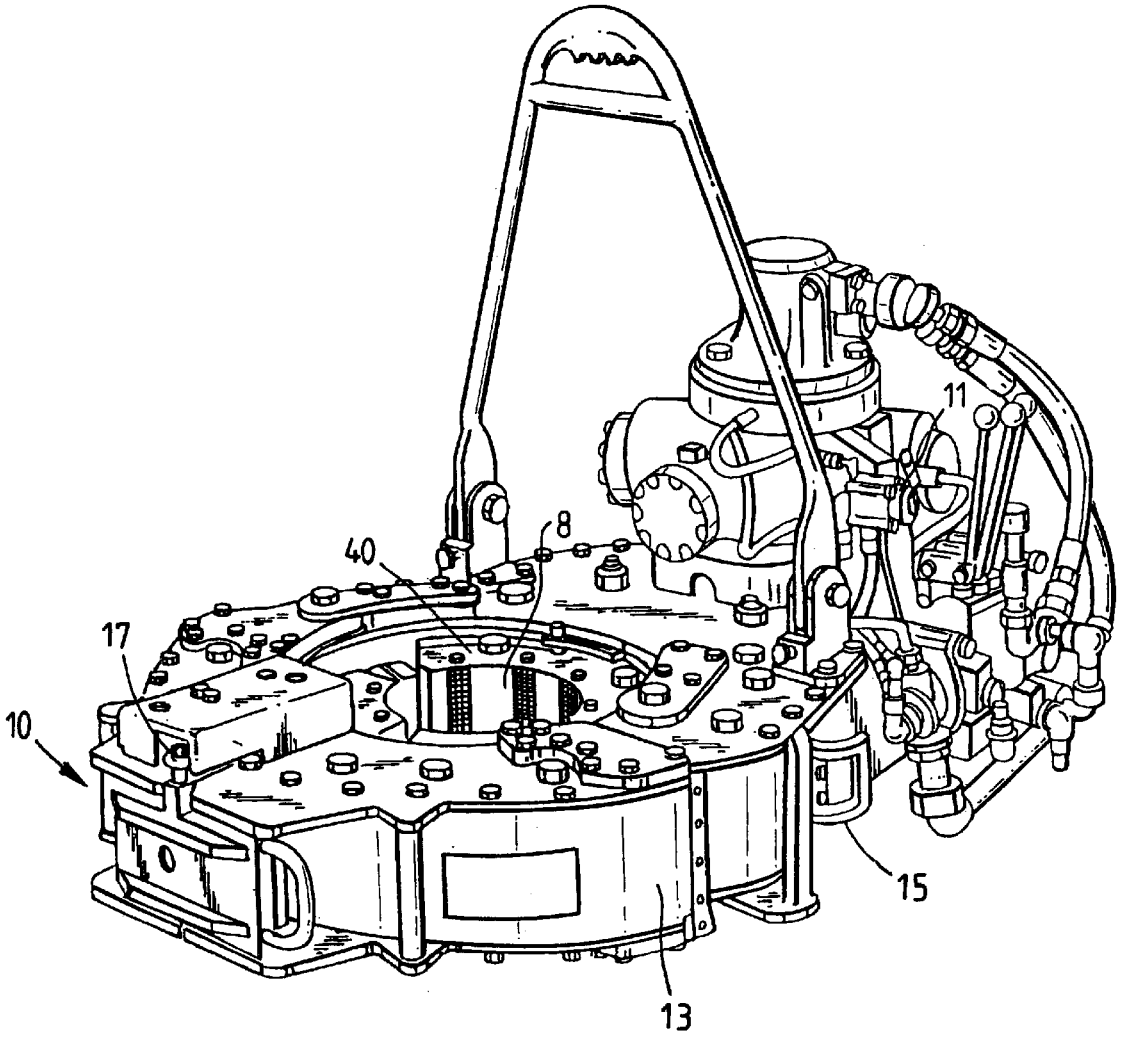
FIG. 3A is a perspective view of a tong according to the present invention.
Figure 3B:
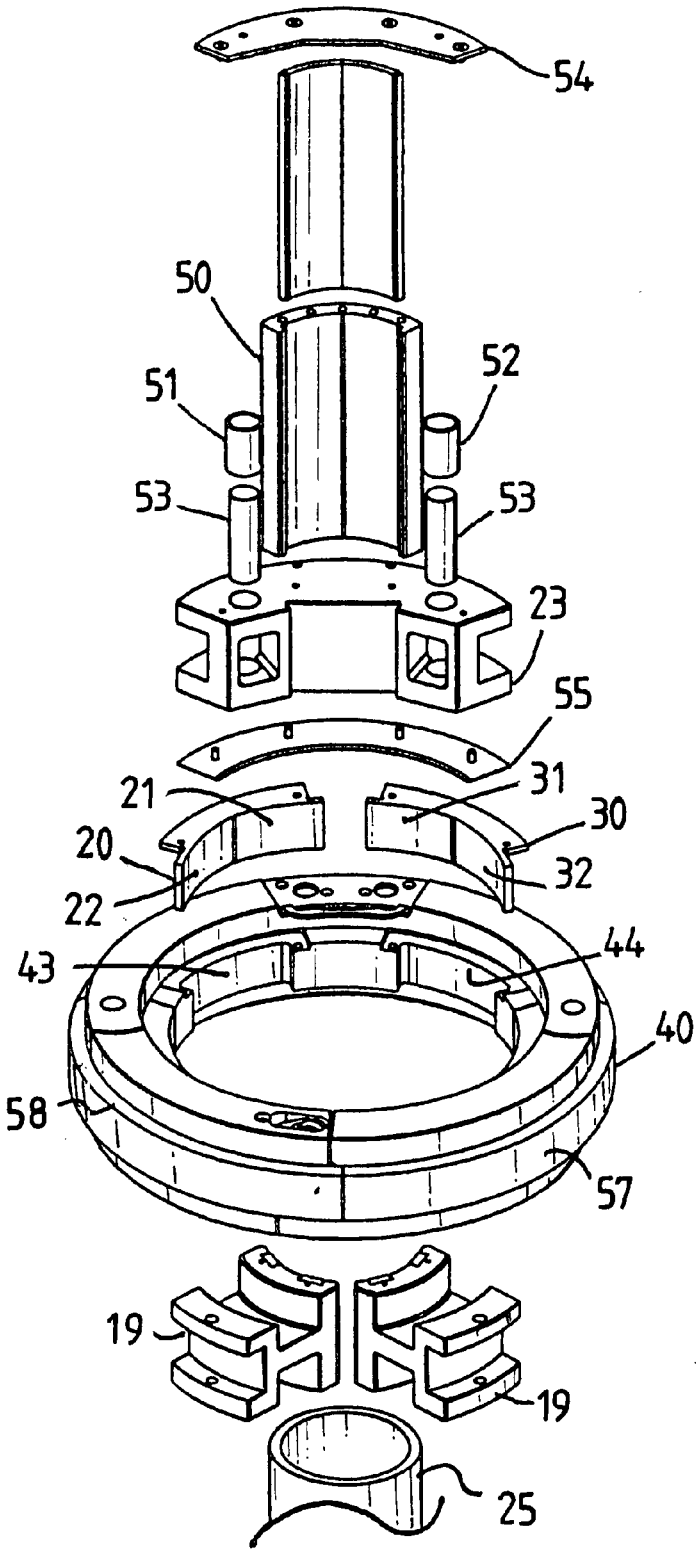
FIG. 3B is an exploded view of part of the tong of FIG. 3A.
Figure 3C:
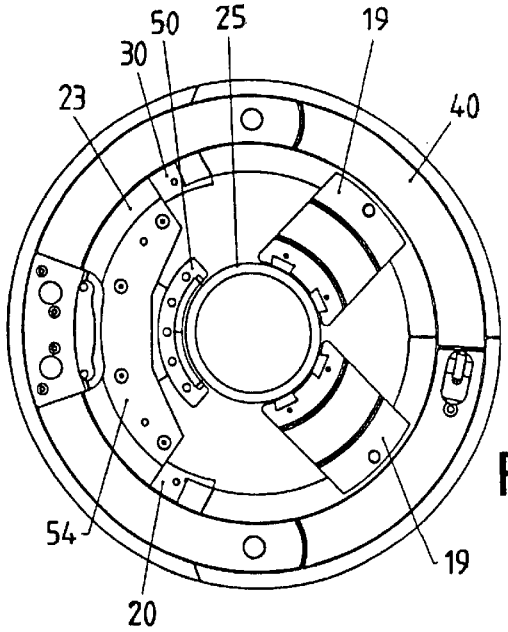
FIG. 3C is a top view of part of the tong of FIG. 3A.
Figure 3D:
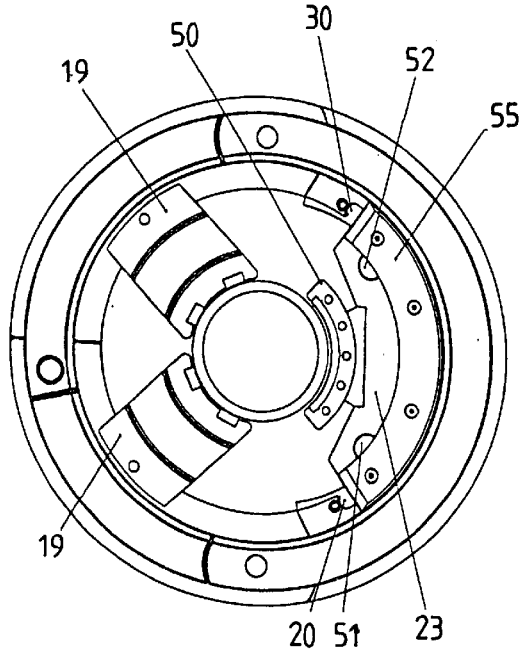
FIG. 3D is a bottom view of the part as shown in FIG. 3C.

FIG. 3A shows a power tong 10 according to the present invention which is like the power tong T of FIG. 1A, but which does not have cam surfaces with the circular section shape (as viewed from above) of the cam surfaces $S_1$–$S_6$. FIGS. 3B and 4A–5D show cam inserts 20 and 30 each with cam surfaces 21, 22 and 31, 32 respectively. Each of the cam surfaces 21, 22, 31, 32 is non-circular as viewed from above to facilitate the maintenance of a desired cam angle when cam following rollers 12 of an active jaw 14 are located anywhere on the cam surfaces so that a desired force is exerted consistently on a tubular. Dies 8 engage a tubular to be rotated. It is within the scope of this invention to use any known dies or gripping elements on any jaw of the tong. The additional description of the power tong T above is repeated and incorporated here with respect to the power tong 10.

As shown in FIG. 3A, the power tong 10 has an hydraulic shifting mechanism 11; a case 13; a brake system 15; a safety interlock system 17; and a rotary 40. Two fixed or "centering" jaws 19 are secured to the rotary 40. A movable jaw 50 secured to a cradle 23 has two spaced-apart cam following rollers 51, 52 that move on the cam surfaces of the cam inserts 20 and 30, respectively to move the movable jaw 50 with respect to a tubular passing through the tong 10 that is to be rotated, e.g. a pipe 25. Each roller 51, 52 (shown in FIG. 3E with cradle 23 removed) is mounted on a roller shaft 53. A cover 54 secured on top of the cradle 23 holds the roller shafts in place. A latch 56 releasably latches optional 57 and 58 of the rotary shut. A brake block 55 secured to the cradle 23 is part of the brake system 15 and is used to retard the cradle, preventing its rotation while the rotary and cams advance the cradle and jaw toward the pipe, thus temporarily retarding motion of the cradle with respect to the rotary facilitates cam operation. A rounded edge dovetail structure 43, 44 on each cam insert 20, 30 respectively facilitates securement of the cams in corresponding recesses 43*a*, 44*a* of the rotary 40.

It is within the scope of this invention to provide any tong employing a cam surface which is contacted by a cam follower or cam following roller with a non-circular cam surface (non-circular as viewed from above viewing an edge of the cam surface that defines the shape thereof) that facilitates maintenance of a desired cam angle and, in one particular aspect, maintenance of a desired cam angle substantially along the entire length of the cam surface and/or maintenance of a desired cam angle, preferably within 0.95 degrees of tolerance, plus or minus, and most preferably within 0.50 degrees, plus or minus. As shown in FIGS. 4A–5D, the various non-circular cam surfaces 21, 22 and 31, 32 are portions of an Archimedes spiral. These particular cam surfaces are designed to maintain a cam angle of about 5½ degrees (with tolerances as stated above) for the roller/cam interface along the entire cam surface. In certain preferred embodiments useful cam angles range between 2° and 30°.

Figure 1H:
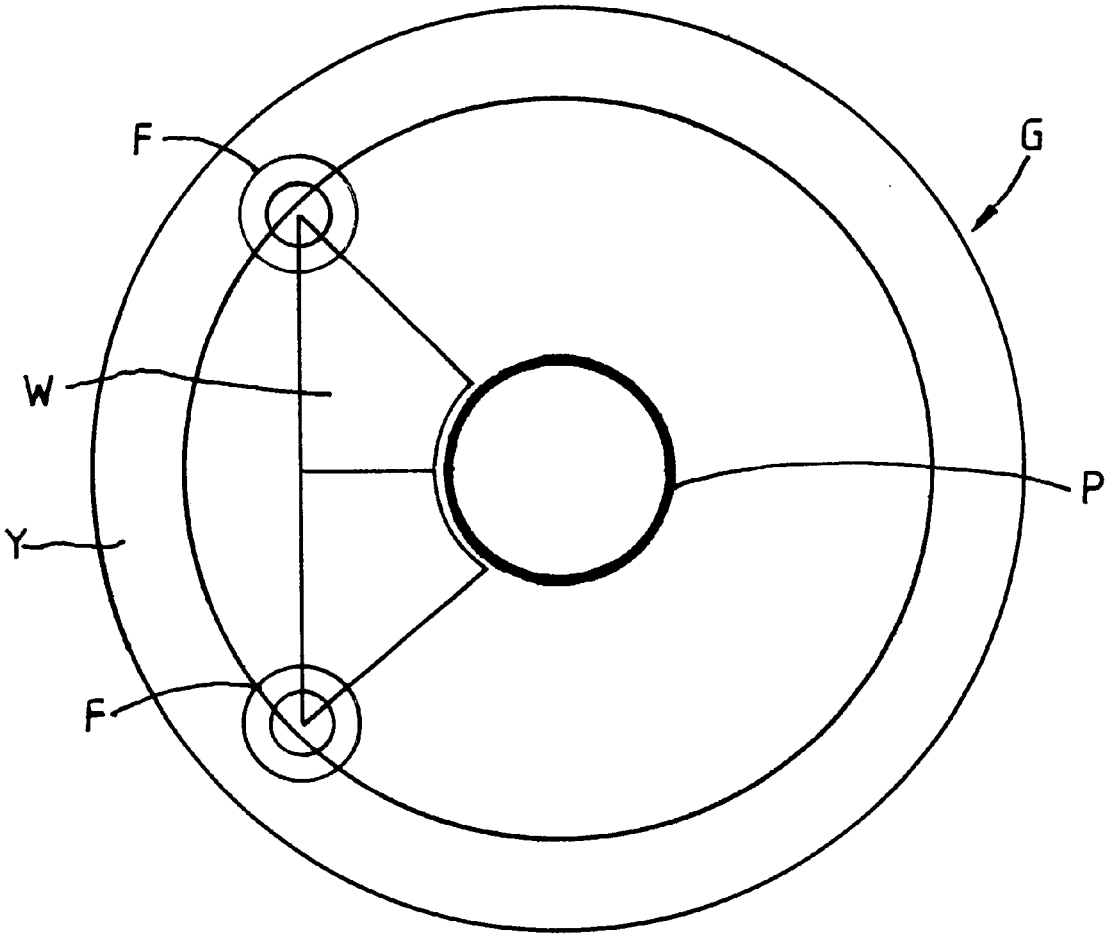
Fig. 1H Prior Art
FIG. 1H is a top schematic cross-section view of part of a prior art tong.
Figure 2A:
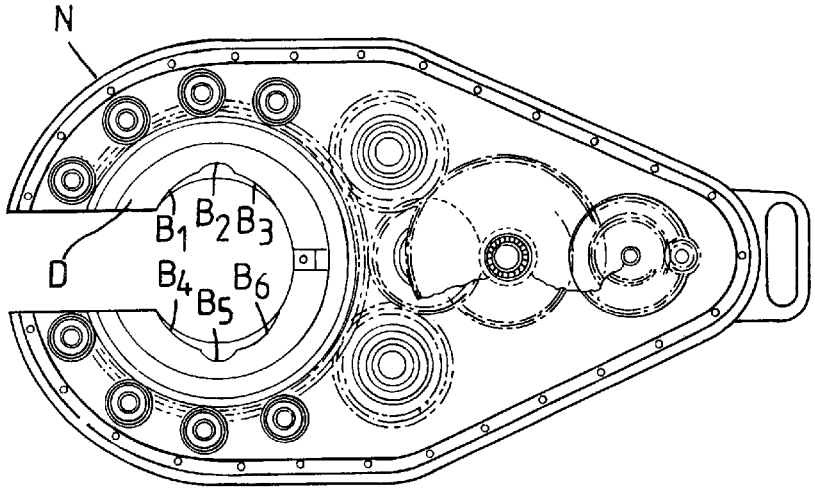
Fig. 2A Prior Art
FIG. 2A is a top view of part of a prior art tong.
Figure 2B:
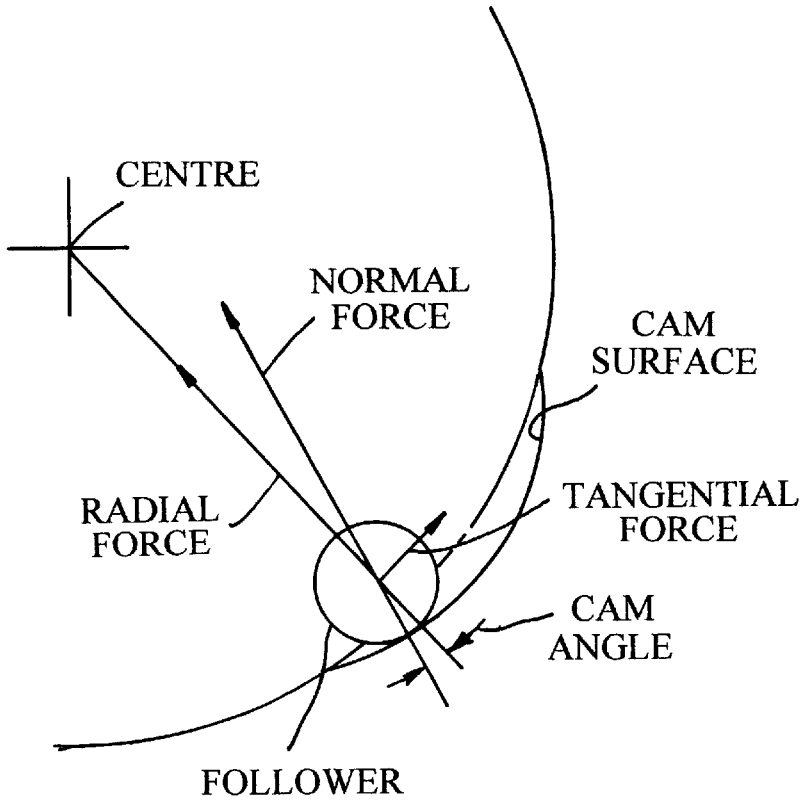
FIG. 2B is a diagram regarding a tong cam angle.
Figure 3E:
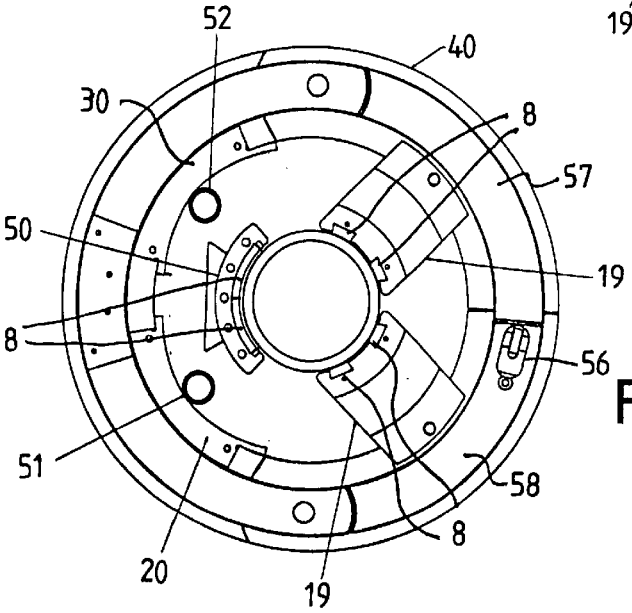
FIG. 3E is a top view of part of the tong of FIG. 3A.
Figure 4A:
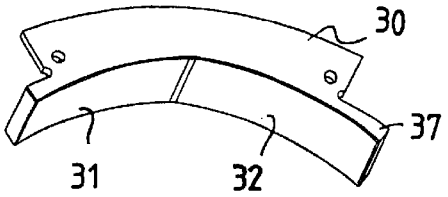
FIG. 4A is a top perspective view of a tong cam according to the present invention.
Figure 4B:
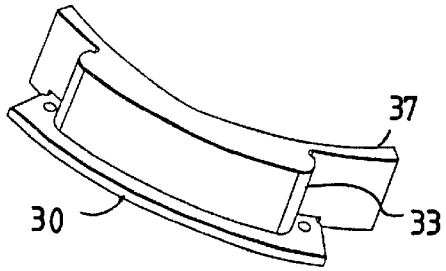
FIG. 4B is a rear view of the tong cam of FIG. 4A.
Figure 4C:
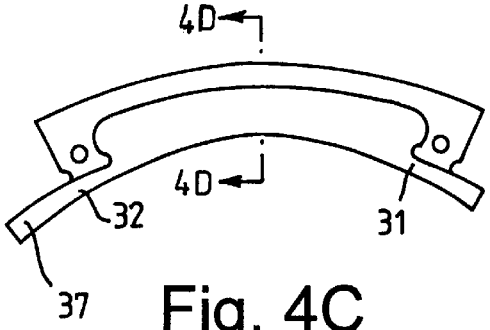
FIG. 4C is a bottom view of the tong cam of FIG. 4A.
Figure 4D:
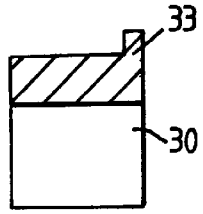
FIG. 4D is a view along line 4D—4D of FIG. 4C.
Figure 5A:
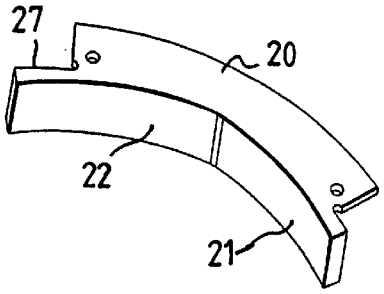
FIG. 5A is a top perspective view of a tong cam according to the present invention.
Figure 5B:
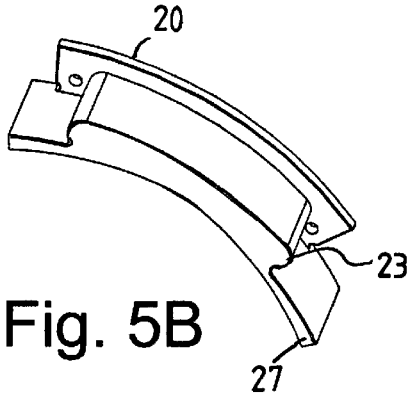
FIG. 5B is a rear view of the tong cam of FIG. 5A.
Figure 5C:
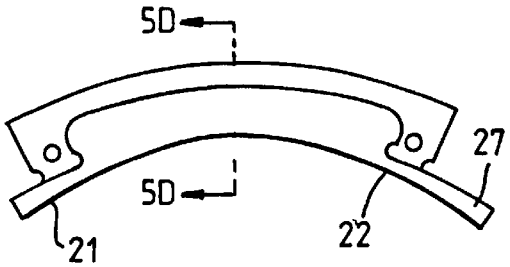
FIG. 5C is a bottom view of the tong cam of FIG. 5A.
Figure 5D:
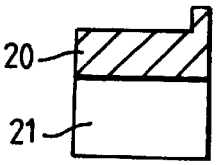
FIG. 5D is a view along line 5D—5D of FIG. 5C.
Figure 6A:
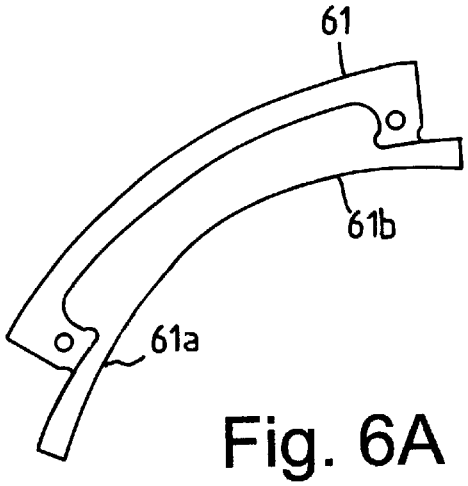
FIGS. 6A–6F are top views of tong cams according to the present invention.
Figure 6B:
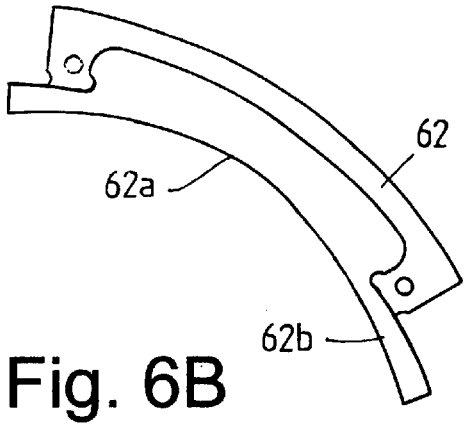
Figure 6C:
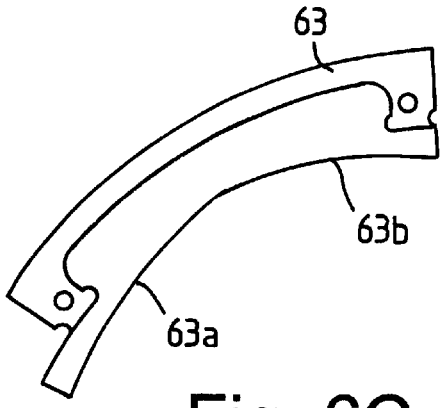
Figure 6D:
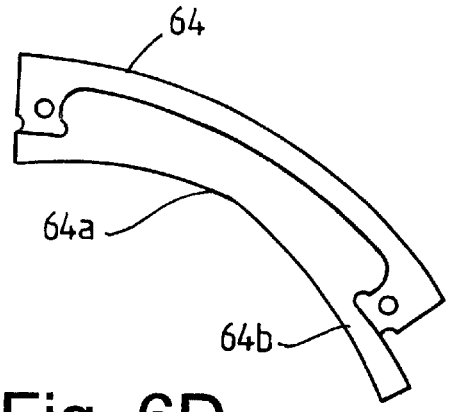
Figure 6E:
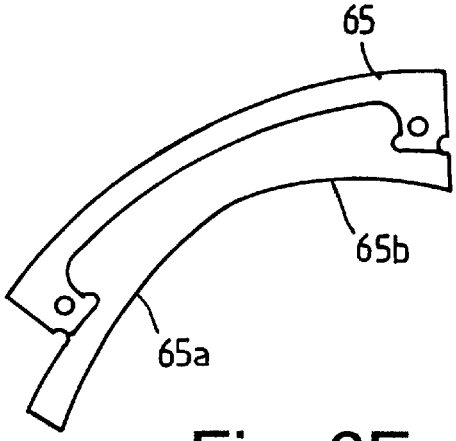
Figure 6F:
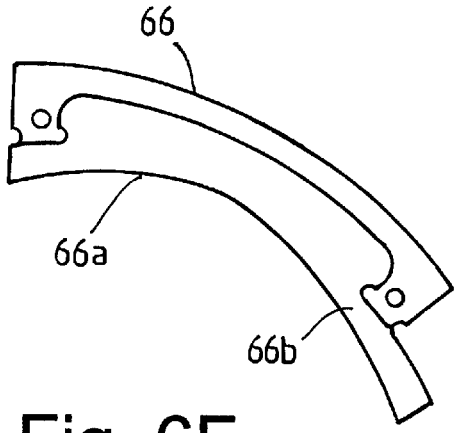
Figure 7A:
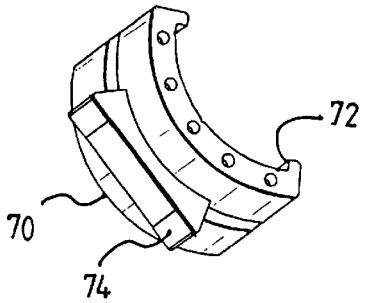
FIG. 7A is a rear perspective view of a tong jaw insert according to the present invention.
Figure 7B:
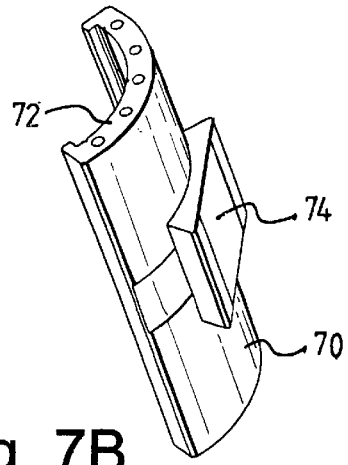
FIG. 7B is a back view of the insert of FIG. 7A.
Figure 7C:
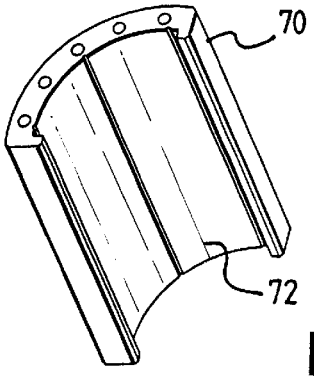
FIG. 7C is a front view of the insert of FIG. 7A.
Figure 7D:
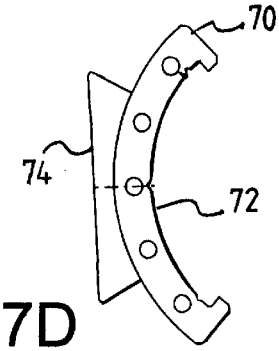
FIG. 7D is a top view of the insert of FIG. 7A.

As shown in FIGS. 3E, 4C and 5C, the cams 20 and 30 each have asymmetrical surfaces 21, 22 and 31, 32, respectively. By using such asymmetrical surfaces, the problem illustrated in FIG. 1H is alleviated or overcome; i.e., by employing such asymmetrical surfaces, each of the cam following rollers 51, 52 is maintained in contact with its corresponding cam surface so that the jaw 50 is applied in a balanced even manner to the pipe 25 (as in FIG. 3E).

In the preferred embodiments shown in FIGS. 3E, 4C and 5C, by "asymmetrical" is meant that the "inboard" cam surfaces 21, 31 are not symmetrically shaped or configured with respect to the corresponding "outboard" cam surfaces 22, 32, respectively, e.g. with respect to the intersections of the surfaces.

Extended cam surface portions 27, 37, referred to as "ears" or "wings" are optional and are used for greater radial jaw movement on existing rotaries and for increasing cam travel in existing tongs to accommodate tolerances in tong and pipe structure and size.

FIGS. 6A–6F present a set of cams 61, 62, 63, 64, 65 and 66 each with corresponding cam surfaces designated by these numerals with "a" or "b". The cams of FIGS. 6A and 6B correspond, respectively, to the cams 31, 21 respectively described above and are designed to maintain a cam angle of about 6.5 degrees; those of FIGS. 6C and 6D, a cam angle of about 7.5 degrees; and those of FIGS. 6E and 6F, a cam angle of about 8.75 degrees. It is within the scope of this invention to provide for a particular tong a set of a plurality of cams of any desired number to achieve any desired cam angles. It is within the scope of this invention that a cam on one side produce a cam angle x, and a cam on other side produce a cam angle y, where y is not equal to x.

FIGS. 7A–7D present a jaw 70 according to the present invention having a carrier 72 for a die, dies, and/or gripping element(s) with a rear mounting structure 74 for mounting the jaw 70 to a cradle (as the jaw 50 is mounted to the cradle 23 as described above. The jaw 50 may be mounted to the cradle 23 in any suitable manner, with or without a mounting structure like the mounting structure 74).

Figure 8A:
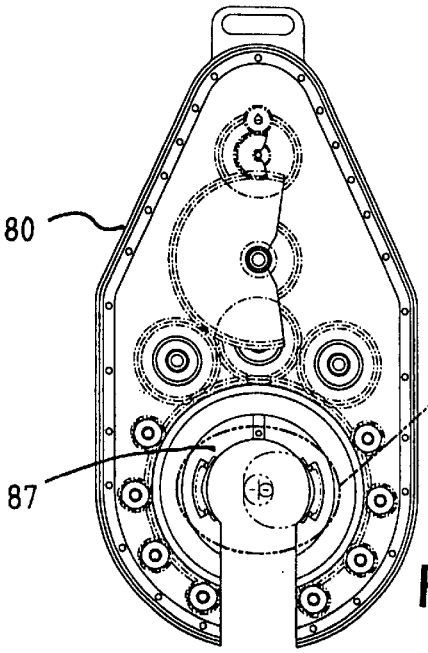
FIG. 8A is a top view of a tong according to the present invention.
Figure 8B:
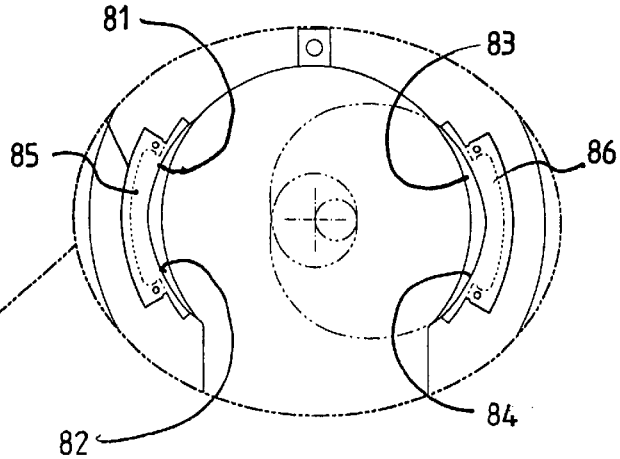
FIG. 8B is an enlargement of part of the tong of FIG. 8A.

FIGS. 8A and 8B show a tong 80 which is an improvement of the tong of U.S. Pat. No. 4,404,876, which, to the extent it describes this tong 80 (all but cam surface shapes) is incorporated herein for all purposes. The tong 80 has non-circular cam surfaces 81, 30 82, 83, and 84, like the previously described non-circular cam surfaces. Cam inserts 85, 86, respectively with these surfaces are mounted to a rotary 87 (as are, e.g., the cams 20, 30 described above).

In certain preferred embodiments, therefore, the present invention discloses a tong for rotating tubulars in wellbore operations, the tong having a tong outer case, a rotary movably mounted in the case for rotating a tubular, apparatus for rotating the rotary to rotate the tubular, at least one gripper movably mounted within the rotary and movable by the rotary to grip the tubular, the at least one gripper having at least one cam following member, and at least one non-circular cam surface on the rotary, the at least one cam following member contacting and movable on the at least one non-circular cam surface for maintaining a desired position of the at least one gripper with respect to the tubular. Such a tong may also have one, some, or all of the following: at least one centering gripper on the rotary for facilitating the gripping of the tubular, and in one particular aspect two centering grippers; the at least one non-circular cam surface comprising a plurality of non-circular cam surfaces; the at least one non-circular cam surface having a shape of part of a spiral, and, in one aspect the spiral is an Archimedes spiral; the at least one gripper is at least one jaw; the at least one jaw is a plurality of jaws; the at least one gripper includes at least one gripping element (e.g. die, dies, and other tubular engaging elements) for engaging the tubular, the at least one cam following member is a structural member, part of a jaw, a roller or rollers movably mounted on the at least one gripper; the at least one non-circular cam surface is on a cam member, the cam member on the rotary; the cam member is secured on the rotary; the cam member is releasably secured on the rotary; the at least one non-circular cam surface is formed integrally of the rotary; the at least one non-circular cam surface is at least two adjacent non-circular cam surfaces; the at least two adjacent non-circular cam surfaces is two asymmetrical surfaces; the at least one non-circular cam surface is two spaced-apart pairs of cam surfaces, each pair comprising two adjacent non-circular cam surfaces; each two adjacent non-circular cam surfaces are asymmetrical; the at least one cam following member is two spaced-apart cam following rollers movably mounted on the at least one gripper; the desired position of the at least one gripper is maintained with a cam angle within a cam angle range of about 2 degrees to about 30 degrees; the cam angle ranges between about 3 to about 9 degrees; the cam angle is maintained within a tolerance of plus or minus 0.95 degrees; the cam angle is maintained within a tolerance of plus or minus 0.50 degrees.

The present invention, in certain preferred embodiments, discloses a tong for rotating tubulars in wellbore operations, the tong having a tong outer case, a rotary movably mounted in the case for rotating a tubular, apparatus for rotating the rotary to rotate the tubular, a plurality of jaws movably mounted within the rotary and movable by the rotary to grip the tubular, each jaw having at least one cam following member, and a plurality of non-circular cam surfaces on the rotary each with a shape of part of a spiral, the at least one cam following member contacting and movable on the at least one non-circular cam surface for maintaining a desired position of the at least one gripper with respect to the tubular, at least one centering gripper on the rotary for facilitating gripping of the tubular, and the non-circular cam surfaces on a cam member, the cam member releasably secured on the rotary.

The present invention discloses methods for rotating a tubular, the method including positioning a tong about the tubular, the tong being any tong disclosed herein, and rotating the tubular with the tong.

The present invention, in certain embodiments, discloses a cam member for a tong (e.g. securable to or formed integrally of a rotary or securable to or formed integrally of a gripper or jaw), the cam member having at least one non-circular cam surface. Such a cam member may have one, some or all of the following: the at least one non-circular cam surface is at least two adjacent non-circular cam surfaces; the at least two adjacent non-circular cam surfaces is two asymmetrical surfaces; the at least one non-circular cam surface is two spaced-apart pairs of cam surfaces, each pair comprising two adjacent non-circular cam surfaces; and/or each two adjacent non-circular cam surfaces are asymmetrical.

The present invention, in certain embodiments discloses a set of cam members for a tong, the set comprising a plurality of cam members, each cam member releasably securable to a part of the tong (e.g. but not limited to a rotary or to a jaw of a tong) and having at least one non-circular cam surface.

The present invention, in certain embodiments, discloses a rotary for a tong, the rotary having a rotary body, and at least one non-circular cam surface on the rotary body.

Although the cam members and cam surfaces described above have been described as on a rotary, it is within the scope of this invention to provide such a surface or surfaces on a gripper or jaw and to have a cam following member or roller on the rotary for co-action therewith to effect the gripping described herein. In two actual embodiments of the Weatherford 14.50 tong described above, cam angles of 7.5 and 8.75 degrees have been used effectively.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A tong for rotating tubulars, the tong comprising a tong outer case, a rotary movably mounted in the case for rotating a tubular, apparatus for rotating the rotary to rotate the tubular, at least one gripper movably mounted within the rotary and movable by the rotary to grip the tubular, the at least one gripper having at least one cam following member, at least one non-circular cam surface on the rotary, the at least one cam following member contacting and movable on the at least one non-circular cam surface for maintaining a desired position of the at least one gripper with respect to the tubular, at least one centering gripper on the rotary for facilitating the gripping of the tubular, the at least one non-circular cam surface having a shape of part of a spiral, wherein the spiral is an Archimedes spiral.

2. A tong for rotating tubulars, the tong comprising a tong outer case, a rotary movably mounted in the case for rotating a tubular, apparatus for rotating the rotary to rotate the tubular, at least one gripper movably mounted within the rotary and movable by the rotary to grip the tubular, the at least one gripper having at least one cam following member, at least one non-circular cam surface on the rotary, the at least one cam following member contacting and movable on the at least one non-circular cam surface for maintaining a desired position of the at least one gripper with respect to the tubular, wherein the at least one non-circular cam surface is two spaced-apart pairs of cam surfaces, each pair comprising two adjacent non-circular cam surfaces, and wherein the at least one cam following member is two spaced-apart cam following rollers movably mounted on the at least one gripper.

3. A tong for rotating tubulars, the tong comprising a tong outer case, a rotary movably mounted in the case for rotating a tubular, apparatus for rotating the rotary to rotate the tubular, at least one gripper movably mounted within the rotary and movable by the rotary to grip the tubular, the at least one gripper having at least one cam following member, at least one non-circular cam surface on the rotary, the at least one cam following member contacting and movable on the at least one non-circular cam surface for maintaining a desired position of the at least one gripper with respect to the tubular, and wherein the desired position of the at least one gripper is maintained within a cam angle range of about 2 degrees to about 30 degrees.

4. The tong of claim 3 wherein the cam angle ranges between about 3 to about 9 degrees and a specific cam angle of the tong is maintained within a tolerance of plus or minus 0.95 degrees.

5. A tong for rotating tubulars, the tong comprising a tong outer case, a rotary movably mounted in the case for rotating a tubular, apparatus for rotating the rotary to rotate the tubular, at least one gripper movably mounted within the rotary and movable by the rotary to grip the tubular, the at least one gripper having at least one cam following member, at least one non-circular cam surface on the rotary, the at least one cam following member contacting and movable on the at least one non-circular cam surface for maintaining a desired position of the at least one gripper with respect to the tubular, and wherein a cam angle of the tong is maintained within a tolerance of plus or minus 0.50 degrees.

* * * * *